United States Patent [19]

Rider

[11] 4,239,268

[45] Dec. 16, 1980

[54] SLIDING DOOR LOCK

[76] Inventor: Harlan H. Rider, 10502 - 203 Ave. East, Sumner, Wash. 98390

[21] Appl. No.: 912,307

[22] Filed: Jun. 5, 1978

Related U.S. Application Data

[63] Continuation-in-part of Ser. No. 832,737, Sep. 12, 1977, abandoned.

[51] Int. Cl.[3] ..... E05B 65/08; E05C 5/00

[52] U.S. Cl. ..... 292/5; 70/100; 70/114; 292/11; 292/197; 292/199; 292/DIG. 46

[58] Field of Search ..... 292/11, 27, 49, 51, 292/98, 129, 229, 197, 199, 215, DIG. 46, 46, 5; 70/142, 100, 131, 136, 137, 114

[56] References Cited

U.S. PATENT DOCUMENTS

| | | | |
|---|---|---|---|
| 512,139 | 1/1894 | Willard | 292/46 |
| 840,297 | 1/1907 | Campbell | 292/27 |
| 1,083,173 | 12/1913 | Zeckhauser | 292/5 |
| 1,159,067 | 11/1915 | Morris | 70/131 |
| 1,168,524 | 1/1916 | Lurie | 292/46 |
| 1,478,343 | 12/1923 | Looney | 292/27 |
| 2,107,299 | 2/1938 | Kilpatrick | 70/142 X |
| 2,668,073 | 2/1954 | Collar et al. | 70/131 X |
| 2,784,019 | 3/1957 | Des Combes | 292/DIG. 46 |
| 3,172,280 | 3/1965 | Cohen | 70/100 |
| 3,175,376 | 3/1965 | Cantwell | 70/131 |
| 3,884,056 | 5/1976 | East et al. | 292/98 X |
| 3,899,201 | 8/1975 | Paioletti | 70/100 X |
| 4,050,272 | 9/1977 | Tanaka | 292/DIG. 46 |

FOREIGN PATENT DOCUMENTS

| | | | |
|---|---|---|---|
| 1030726 | 5/1958 | Fed. Rep. of Germany | 292/51 |
| 21570 | of 1903 | United Kingdom | 70/100 |
| 217813 | 6/1924 | United Kingdom | 70/100 |

OTHER PUBLICATIONS

"First Aid to Sliding Doors" from Lockwood, Lockwood Hardware Manufact. Co., *American Builder,* Nov. 1954, vol. 76, No. 11, p. 108.

*Primary Examiner*—Rodney H. Bonck
*Attorney, Agent, or Firm*—Robert W. Beach; Ward Brown

[57] ABSTRACT

A vertical edge of a sliding door has a cavity forming a housing for a bolt. One or two angle-shaped latch leaves are located at a side or opposite sides of the bolt, each leaf being pivotally mounted in the housing for swinging about an axis generally aligned with such door vertical edge. Outward sliding of the bolt swings the latch leaf or leaves outward to lock flanges on the leaf or leaves in a catch carried by a frame.

23 Claims, 14 Drawing Figures

SLIDING DOOR LOCK

This application is a continuation-in-part of application Ser. No. 832,737, filed Sept. 12, 1977 for Sliding Door Lock and now abandoned.

BACKGROUND OF THE INVENTION

1. Field of the Invention

The present invention relates to locks, particularly to sliding door locks.

2. Prior Art

Attempts to provide sturdy internal locking mechanism for sliding doors have been unsuccessful. Prior sliding door locks have included narrow hooks carried by the door and swingable in the same direction about a common axis to engage apertures in a frame, or projecting door hooks rotatable about their shanks fitted in elongated slots in a frame. In the swinging hook lock, the hooks extend in the same direction and if the door fits loosely in its frame the door can be lifted to remove the hooks from the frame apertures. In the rotating hook lock, the area of engagement between the hooks and the frame is so small that the door can be jimmied easily. Consequently, neither of these devices has solved the problem of providing a sturdy lock for connecting a sliding door to a frame securely.

SUMMARY OF THE INVENTION

It is an object of the present invention to provide sturdy concealed locking mechanism for closure members openable relative to frame members.

It is also an object of the present invention to provide such locking mechanism in which the closure member is a sliding door.

A further object is to provide sturdy locking mechanism for sliding doors which mechanism can be actuated quickly and easily to lock a door to a frame securely.

The foregoing objects can be accomplished by providing an angle-shaped latch leaf carried by the door including a latch flange movable to a locking position spaced from an edge of the door. A bolt is engageable with the latch leaf to move the latch leaf latch flange to its locking position and a catch is carried by the frame to receive such flange for locking the door to the frame.

In one embodiment of the invention, two angle-shaped latch leaves located at opposite sides of the bolt are pivotally carried by the door for swinging in opposite directions about parallel axes generally aligned with a vertical edge of the door. In another embodiment, a single latch leaf is swung into a locking position by a rack and pinion actuated swinging bolt.

DETAILED DESCRIPTION

Figure 1:
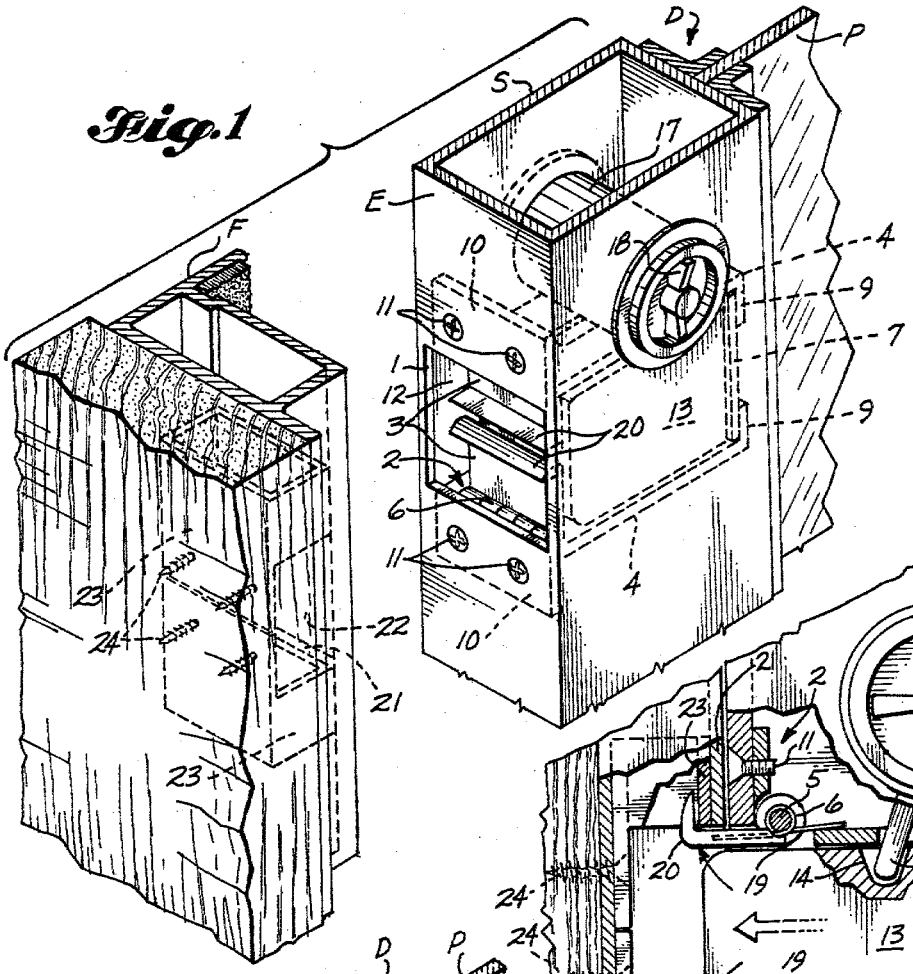
FIG. 1 is a fragmentary top perspective of a sliding door and a frame, including a lock in accordance with the present invention.

The present invention may be used as locking mechanism for various types of closure members, such as various types of windows and doors. In the preferred embodiment of the invention, locking mechanism in accordance with the present invention is used as a sturdy sliding door lock.

In conventional sliding doors, a closure member, such as door D formed by a pane of glass P and a sash S, is slidable on a track or tracks carried by the bottom and/or top of a frame F encircling the door. Usually the frame and the sash are hollow.

In accordance with the present invention, the door vertical edge E adjacent to the frame when the door is closed has a rectangular aperture 1. Hinges 2 are mounted inside the door sash at the top and bottom of aperture 1. Each hinge includes an angle-shaped latch leaf 3 pivotally attached to a mounting plate or leaf 4 by a pin 5 extending through interdigitated knuckles 6. A rear vertical plate 7 and screws 8 connect rear mounting flanges 9 of mounting leaves 4. Front mounting flanges 10 extend from the hinge knuckles away from aperture 1 and are connected to the door edge E by screws 11.

Mounting leaves 4, plate 7 and the inner sides of sash S form a U-shaped housing 12 opening toward the frame and loosely receiving a bolt 13 for sliding toward and away from the frame. Bolt 13 has an upper notch 14 aligned with a slot 15 in the upper mounting leaf. A finger 16 projects downwardly from a rotatable lock cylinder 17 through the upper mounting leaf slot into the bolt notch. An external handle 18 is connected to the cylinder so that inward and outward sliding of bolt 13 in housing 12 can be effected by turning the handle or by turning a key in the lock.

Figure 2:
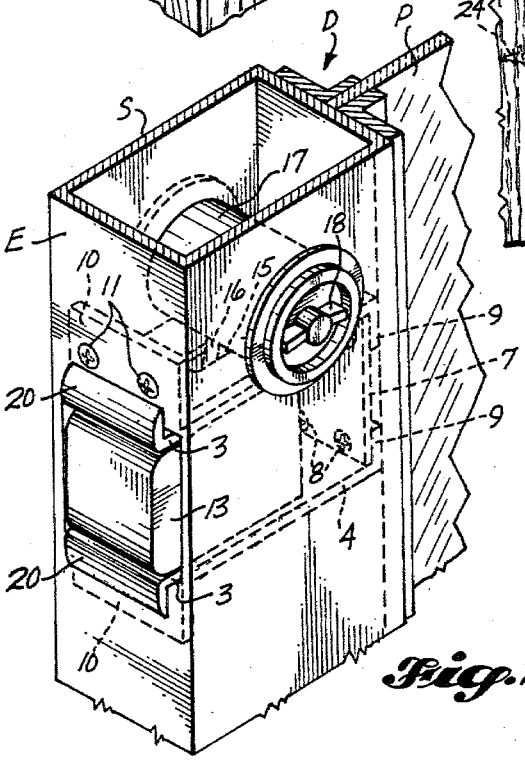
FIG. 2 is a fragmentary top perspective of the door of FIG. 1 with latch flanges in outwardly swung or locking positions.
Figure 5:
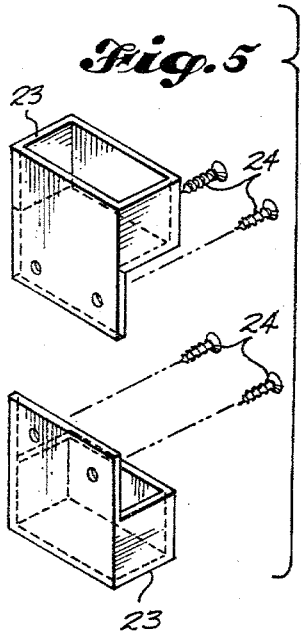
FIG. 5 is an exploded view of the catch mechanism of the lock of FIG. 1.
Figure 6:
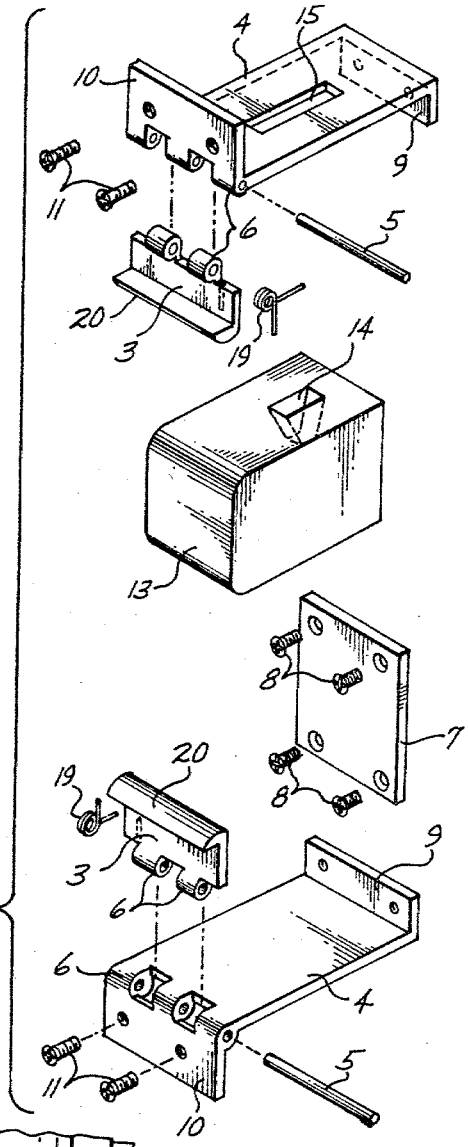
FIG. 6 is an exploded view of the locking mechanism of such lock.

Hinge pins 5 extending through knuckles 6 mount latch leaves 3 for swinging about parallel axes generally aligned with door edge E located at opposite sides of the bolt. Such axes extend transversely of the path of movement of the bolt adjacent to the open end of housing 12. As best seen in FIG. 4, when the bolt is in its innermost position, helical springs 19 carried by the hinge pins 5 bias the latch leaves inwardly with latch leaf latch flanges 20 projecting outwardly in the direction the bolt slides and with no portion of either latch leaf projecting through the door aperture. Turning handle 18 to slide the bolt outwardly forces the outer end of the bolt against the latch leaves and effects outward swinging of the latch leaves in opposite directions through angles of about 90 degrees, from the positions of FIG. 4 to the positions shown in FIG. 2. In their outwardly swung or locking positions, the latch leaf latch flanges are spaced from door edge E. With the bolt in its outermost position, shown in FIGS. 2 and 3, the outer end of the bolt is approximately even with the latch leaf locking flanges so that helical springs 19 cannot force the bolt to slide inwardly when handle 18 is released.

Catch mechanism is provided on the frame for receiving outwardly swung latch leaf latch flanges. In the embodiment shown in the drawings, such catch mechanism is in the form of overhanging edges 21 of a rectangular frame aperture 22 aligned with door aperture 1. Support for the overhanging edges of the frame aperture can be provided by backing members 23 mounted inside the frame by screws 24.

To install the locking mechanism of the present invention in a conventional sliding door, apertures are cut in the sides of the door sash for lock cylinder 17 and rectangular aperture 1 is cut in door edge E. An assembled hinge 2, including a mounting leaf 4, a latch leaf 3, a hinge pin 5, and a helical spring 19, is inserted through the door aperture into the door sash and slid downward so that its mounting leaf forms the bottom of the bolt housing 12. The front mounting flange 10 of the hinge mounting leaf is secured to the door edge by screws 11. Similarly, an assembled hinge having a slot 15 in the hinge mounting leaf is inserted through the door aperture, slid upward and has its front mounting flange secured by screws to form the top of housing 12. The mounting leaf rear mounting flanges 9 are then connected by rear plate 7 and screws 8. Next the latch leaves 3 are swung outwardly and bolt 13 is slid between the latch leaves into the housing formed by the mounting leaves. Finally, the lock cylinder is installed with its finger 16 extending downward through slot 15 of the upper hinge into the upper bolt notch 14.

Catch mechanism may be provided on frame F by cutting frame aperture 22 in alignment with door aperture 1. If desired, a separate backing member 23 may be provided for each overhanging edge of the frame aperture which is to be engaged by a latch leaf latch flange. For example, one backing member may be inserted through frame aperture 22 and slid downward, and then another member can be inserted through the aperture and slid upward. The two members can be secured inside the frame by screws 24 to reinforce the upper and lower overhanging edges of the frame aperture.

Figure 3:
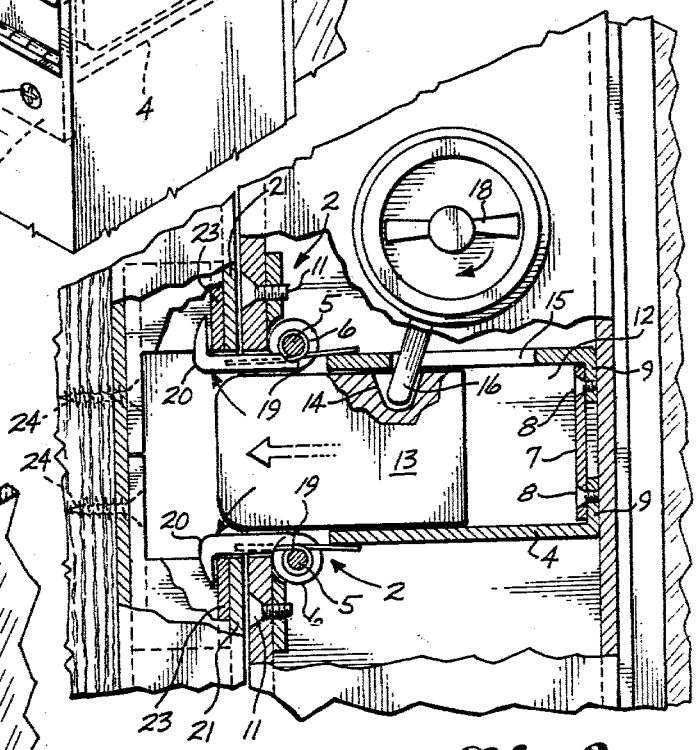
FIG. 3 is a fragmentary side elevation of the door and frame of FIG. 1 in locked relationship, some parts being broken away.
Figure 4:
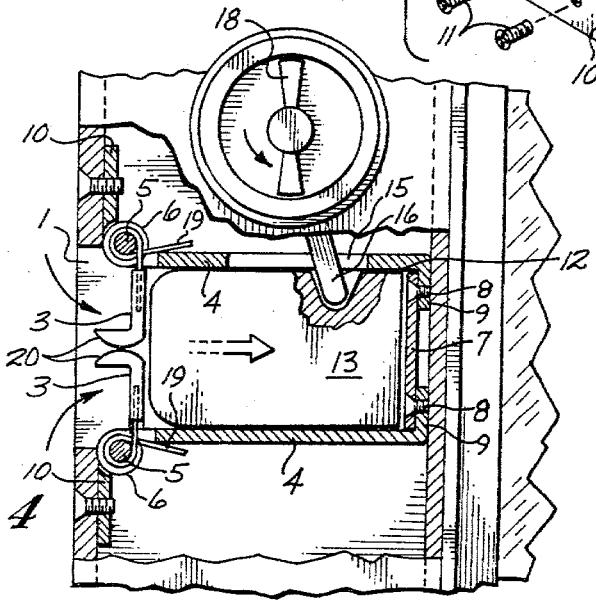
FIG. 4 is a view of a sliding door lock similar to FIG. 3 but with parts in unlocked positions.
Figure 7:
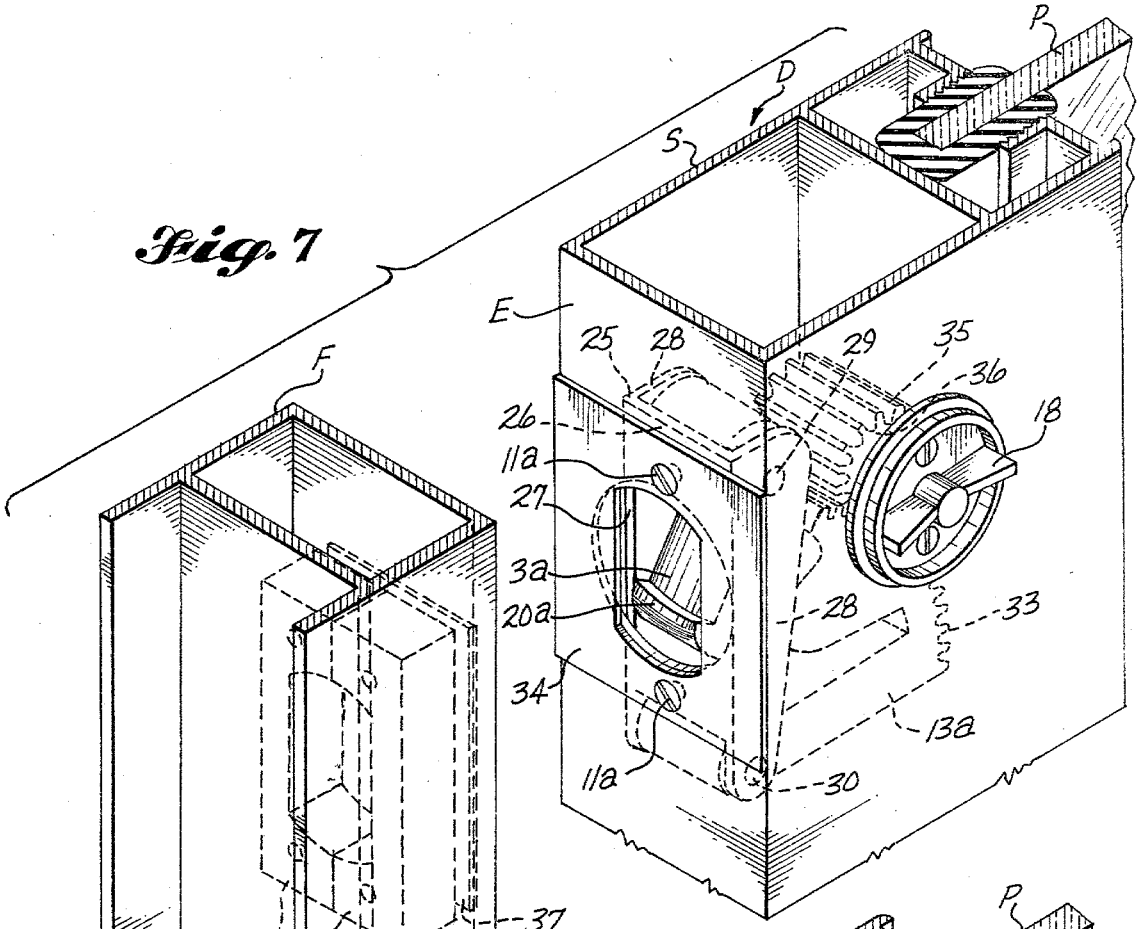
FIG. 7 is a fragmentary top perspective of a sliding door and a frame, including an alternative embodiment of a lock in accordance with the present invention.
Figure 8:
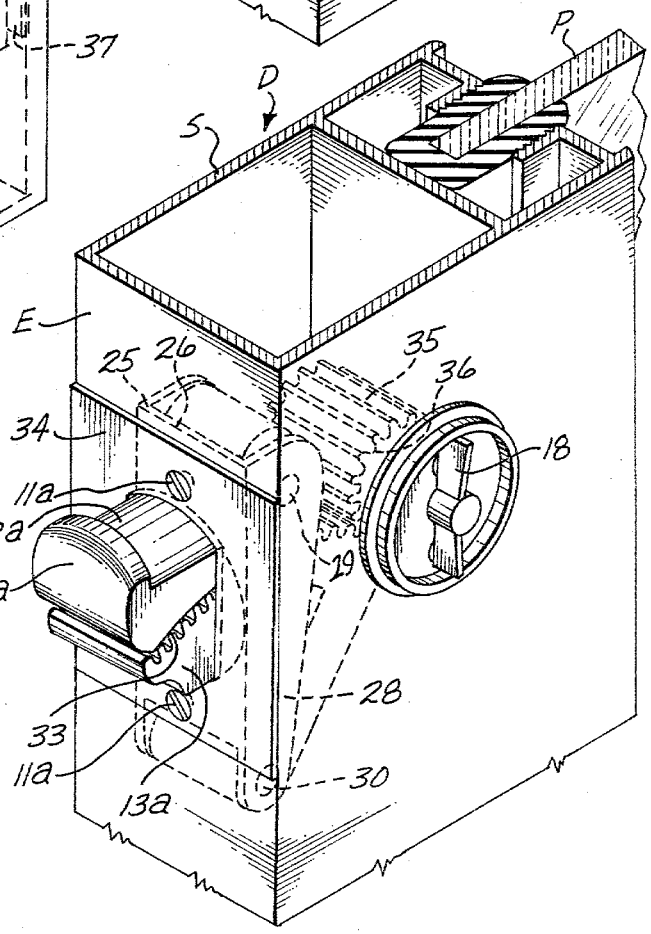
FIG. 8 is a fragmentary top perspective of the door of FIG. 7 with a lock mechanism latch flange and bolt in outwardly swung or locking positions.

As best seen in FIG. 3, when the door is locked the latch flanges are in close relationship to the inner sides of the backing members 23, and the latch leaf portions between the latch flanges and the knuckles 6 are in close relationship to the upper and lower edges of the door and frame apertures. Further, the edges of the latch leaves are in close relationship to the edges of the door and frame apertures. Consequently, movement of the door relative to the frame in any direction is severely limited, and the door cannot be jimmied easily because of the substantial area of engagement between the latch leaves and the frame catch mechanism. The door can be unlocked by simply turning handle 18 to effect inward sliding of bolt 13, whereupon helical springs 19 swing the latch leaves inward toward each other to release their latch flanges from the frame catch mechanism.

In the alternative embodiment of FIGS. 7 through 14, a locking mechanism assembly includes a mounting channel plate 25 having a plate web portion 26 for engaging the inner side of the door sash edge plate E, an aperture 27 in such web portion and flanges 28 projecting inward from the opposite vertical sides of such web portion. Upper and lower pivot pins 29 and 30, respectively, are journaled in upper and lower apertures 31 and 32, respectively, of the mounting plate flanges 28. The lower pin 30 pivotally carries a swinging bolt **13*a* having an outer arcuate rack portion formed by peripheral gear teeth 33. The upper pin 29, extending through a bore in the latch leaf knuckle 6*a*, pivotally carries a latch leaf 3*a* having a latch flange 20*a*. A helical spring 19*a*** biases the latch leaf to an inward swung position.

Figure 12:
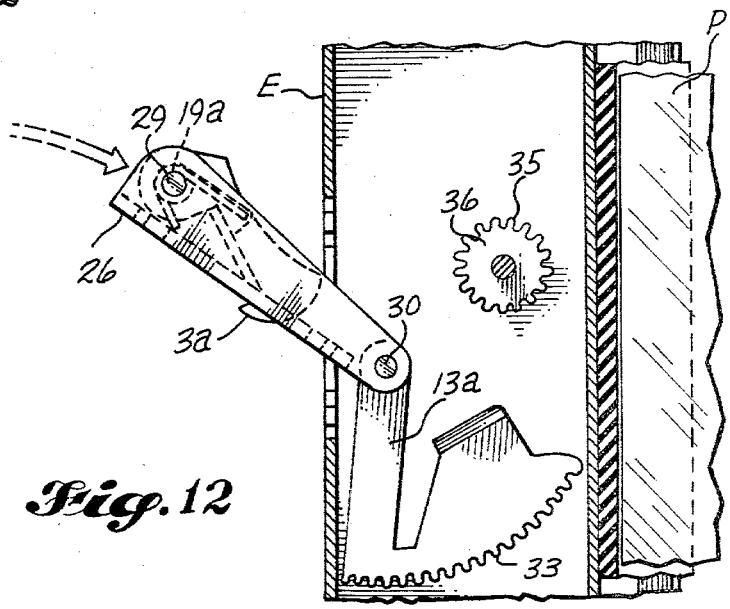
FIG. 12 is a somewhat diagrammatic fragmentary side elevation of a sliding door with parts broken away showing the locking mechanism of FIG. 7 being inserted into such door.

As diagrammatically shown in FIG. 12, the swinging bolt **13*a* of the locking mechanism assembly can be swung generally away from latch leaf 3*a* and inserted through a circular aperture 1*a* in the door vertical edge plate E. The remainder of the locking mechanism assembly can be slid through such aperture as the bolt is slid downward in the door cavity. The mounting channel of the locking mechanism assembly is then secured in position with mounting plate web aperture 27 in alignment with door edge aperture 1*a* by screws 11*a* extending through aligned holes in an apertured faceplate 34, in the door edge plate and in the locking mechanism inner mounting plate web 26**.

Figure 9:
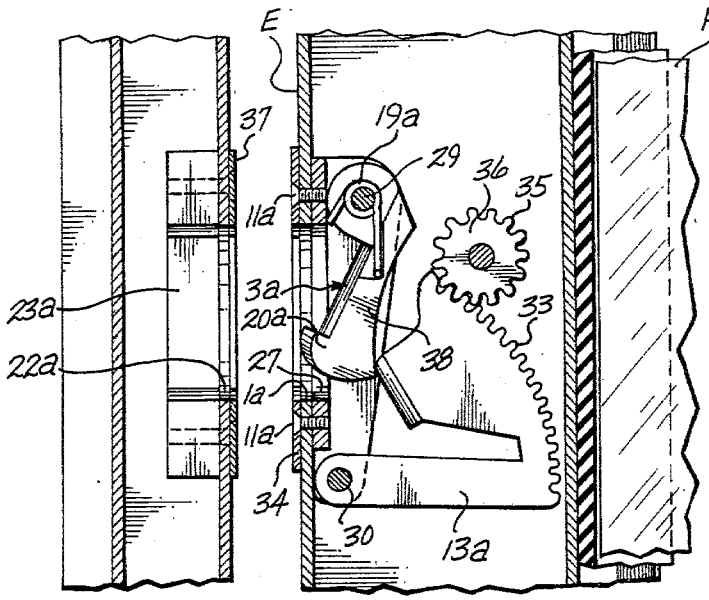
FIG. 9 is a fragmentary side elevation of the door and frame of FIG. 7 in unlocked relationship, some parts being broken away.

After the locking mechanism assembly has been secured in position, bolt **13*a* is swung upward, for example to the position of FIG. 9, and a pinion 36 is dropped into position such that its peripheral gear teeth 35 mesh with teeth 33 of the bolt rack portion. Assembly of the locking mechanism unit is completed by pushing the spline shaft of an actuating handle 18** into the complementally grooved axial bore of the pinion.

Catch mechanism is provided on the frame by the overhanging edges of a circular aperture **22*a* in the plate jamb facing door edge E. U-shaped, thick backing plate members 23*a* are inserted individually through jamb aperture 22*a* and secured in position by screws 24*a* extending through aligned holes in faceplate 37**, in the jamb and in the backing plate members.

Figure 10:
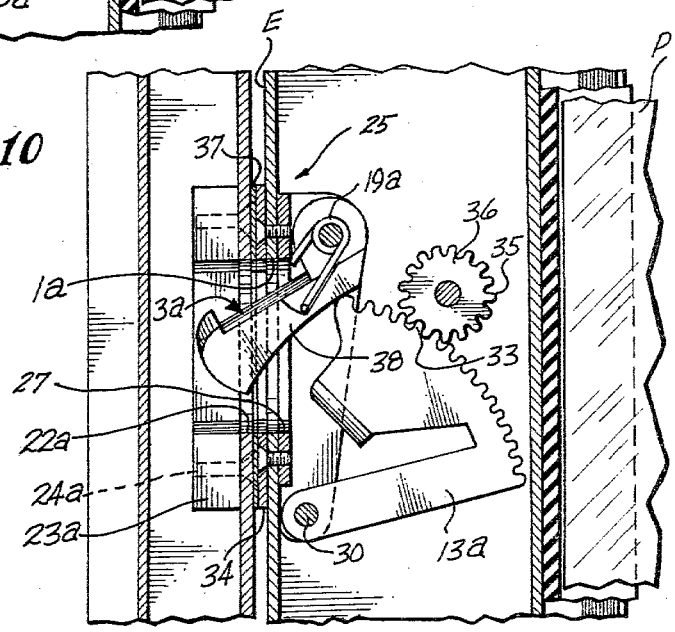
FIG. 10 and FIG. 11 are corresponding fragmentary side elevations with parts in different positions.
Figure 11:
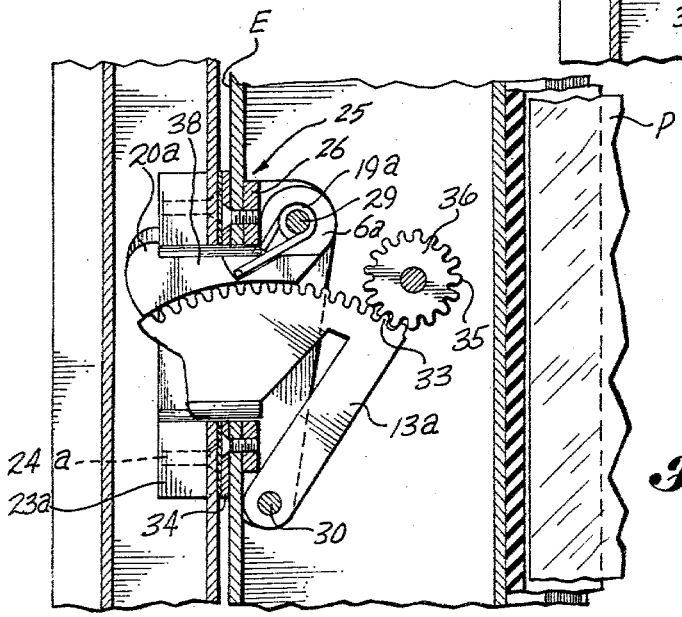
Figure 14:
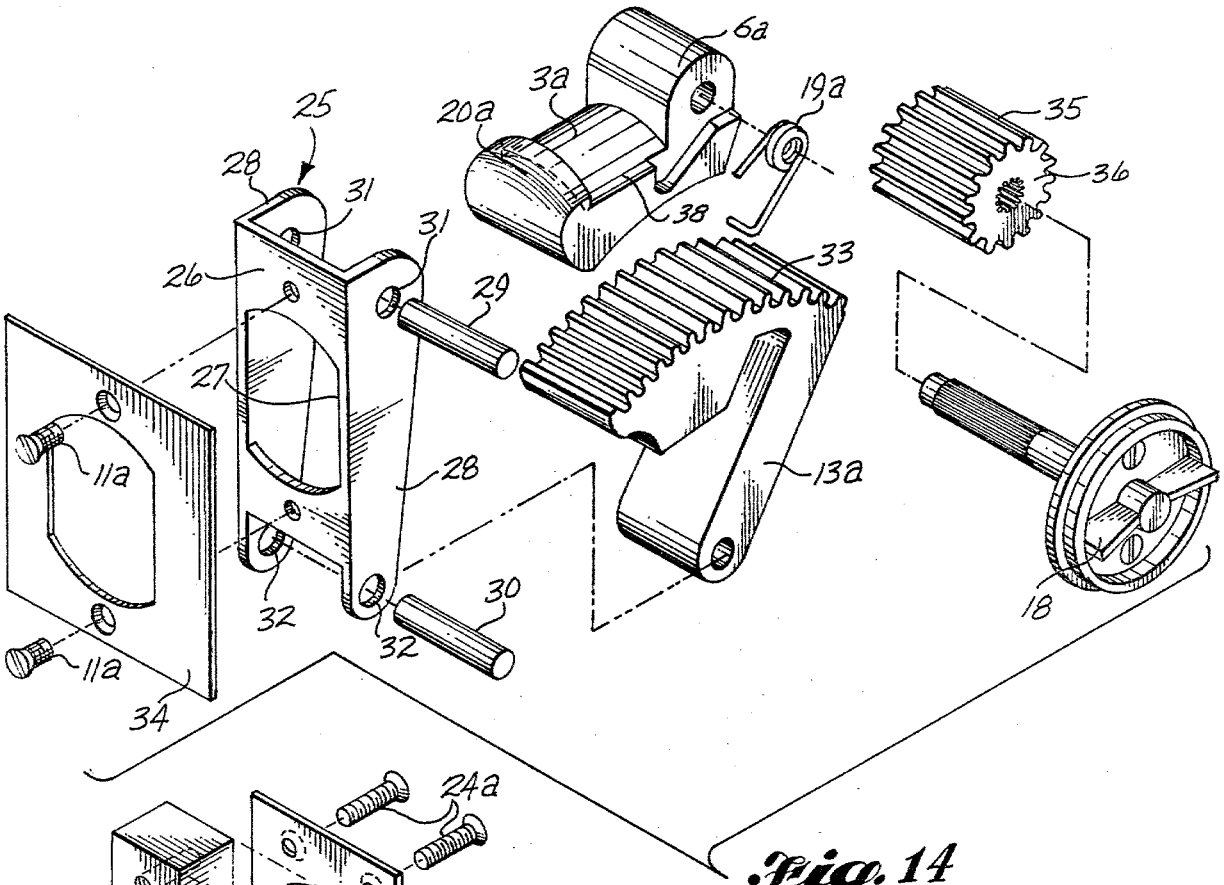
FIG. 14 is an exploded perspective of the locking mechanism of such lock.
Figure 13:
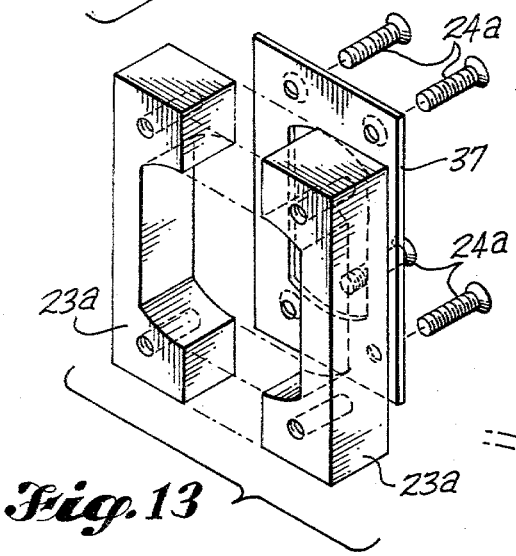
FIG. 13 is an exploded perspective of the catch mechanism of the lock of FIG. 7.

As shown in FIGS. 9, 10 and 11, turning of pinion 35 by handle 18 forces the outer end of bolt **13*a* against the inner side of latch leaf 3*a* and swings it through an angle of about 90 degrees from the position of FIG. 9 to the position of FIG. 11. In the position of FIG. 11, the latch leaf latch flange 20*a* engages behind the inner vertical sides of backing plate members 23*a*, and the latch leaf knuckle 6*a* engages the inner side of the plate web portion 26 of the lock mechanism mounting channel 25**. The snug engagement of the latch leaf latch flange and the latch leaf knuckle with the respective plates secured to the door and frame prevents any movement of the door away from the jamb.

With the bolt in its outermost swung or locking position shown in FIG. 11, the bolt itself engages the bottom of the aperture 27 in the plate web 26 of mounting channel 25, aperture **1*a* in door edge plate E, the aperture in faceplate 34, the aperture in the jamb faceplate 37, the aperture 22*a* in the jamb and the aperture cooperatively formed by the assembled backing members 23*a*, to constitute a stop. The bolt is arcuate complementary to the arcuate bottom of such apertures and the outer side 3*a* of the latch leaf shank 38 between the latch leaf latch flange 20*a* and knuckle 6*a* is arcuate complementary to the arcuate top of such apertures. In addition, the inner side of the latch leaf shank is arcuate complementary to the arcuate rack portion of the swinging bolt. The sides of the bolt and the latch leaf are in close relationship to the sides of such apertures to limit lateral play, and the latch leaf channel opposed abutments snugly embrace between them the pack of plate members formed by the mounting channel plate web 26, the door edge plate, the faceplates, the plate jamb and the jamb backing plate. Consequently, movement of the door relative to the frame in any direction is severely limited and the door cannot be jimmied easily. The door can be unlocked by simply turning handle 18 to rotate pinion 36 to move the bolt inward, whereupon spring 19***a* swings the latch leaf downward to the position of FIG. 9.

I claim:

1. Locking mechanism for a closure member openable relative to a frame member, such members having respective normally registered apertures in corresponding edges thereof, said locking mechanism comprising:

bolt means carried by one of the members and having an outer end portion movable through the member edge apertures between a projected position in which said bolt means bridges between the members and a retracted position in which the bolt means does not bridge between the members;

an elongated latch leaf carried by the bolt-carrying member adjacent to the edge aperture of such member for swinging transversely of the length of said latch leaf through the member edge apertures and having an inner face normally disposed in the path of movement of said bolt means outer end portion, said latch leaf having a latch flange movable by swinging of said latch leaf from an unlocked position in which said latch flange is positioned inward of the face of the apertured edge of the bolt-carrying member to a locking position in which said flange is projected outward beyond the apertured edge of the bolt-carrying member and engages behind an edge of the aperture in the other member for locking the closure member to the frame member;

pivot pin means mounting said latch leaf for swinging about and axis stationary relative to the bolt-carrying member, said pivot pin means being located inward of the face of the apertured edge of the bolt-carrying member; and means for moving said bolt means from retracted position to butt said outer end portion of said bolt means against said inner face of said latch leaf and swing said latch leaf latch flange to locking position and for moving said bolt means outer end portion to projected position bridging between the two members.

2. The locking mechanism defined in claim 1, including resilient means for biasing the latch leaf inward with its inner face butting against the outer end portion of the bolt means.

3. The locking mechanism defined in claim 1, in which the transverse width of the latch leaf and the bolt means are substantially equal, each of such widths being only slightly less than the transverse width of the member edge apertures.

4. The locking mechanism defined in claim 1, the swinging axis of the latch leaf being parallel and closely adjacent to the edge of the bolt-carrying member.

5. The locking mechanism defined in claim 1 or 4, the latch leaf being swingable through an angle of about 90 degrees relative to the bolt-carrying member.

6. The locking mechanism defined in claim 1, the bolt means being swingable about an axis stationary relative to the bolt-carrying member between its projected and retracted positions.

7. The locking mechanism defined in claim 6, the swinging axis of the bolt means being generally parallel to the swinging axis of the latch leaf and closely adjacent to the edge of the bolt-carrying member.

8. The locking mechanism defined in claim 6, the bolt means outer end portion being located inward of the face of the apertured edge of the bolt-carrying member in retracted position.

9. The locking mechanism defined in claim 6, 7 or 8, the bolt means including an arcuate rack portion concentric with the bolt means axis, and the moving means including a rotatable pinion engageable with the bolt means rack portion for swinging the bolt means outer end portion between its projected and retracted positions.

10. The locking mechanism defined in claim 9, in which the bolt means and the latch leaf have portions interengaged when the bolt means outer end portion is in its projected position.

11. The locking mechanism defined in claim 10, the bolt means arcuate rack portion being convex and the latch leaf having a concave portion shaped complementally to and engageable with the bolt means arcuate rack portion.

12. The locking mechanism defined in claim 6, 7 or 8, the bolt means and the latch leaf being swingable in opposite senses about their respective axes.

13. The locking mechanism defined in claim 1, the edge of the bolt-carrying member having a circular aperture and the latch leaf having a convex shank shaped complementary to an arc of such aperture and engageable therewith when the latch leaf latch flange is in locking position.

14. The locking mechanism defined in claim 1, the bolt means outer end portion engaging corresponding edge portions of the member apertures when the bolt means outer end portion is in projected position.

15. The locking mechanism defined in claim 1, in which one of the members carries a plurality of latch leaves each having a latch flange movable to a locking position spaced outward from an edge of such leaf-carrying member, and the bolt means is engageable with each of the latch leaves for moving the latch flanges to their locking positions.

16. The locking mechanism defined in claim 15, in which one of the members carries two latch leaves spaced apart, and the bolt means is located between the two latch leaves.

17. The locking mechanism defined in claim 15, including spaced pivot means mounting the latch leaves, respectively, for swinging away from each other and the bolt means being slidably received between said spaced pivot means and simultaneously engageable with the latch leaves for wedging them apart.

18. The locking mechanism defined in claim 13, in which the pivot means mount the latch leaves for swinging in opposite directions about substantially parallel axes and the bolt means is reciprocable transversely of the pivot means axes.

19. The locking mechanism defined in claim 17, including resilient means for biasing the latch leaves toward each other.

20. The locking mechanism defined in claim 1, in which the closure member and the frame member each include apertured plate means providing registering apertures, the latch leaf includes a shank portion having abutments facing each other and said latch leaf shank portion abutments snugly embrace said plate means when the latch flange is in locking position.

21. Locking mechanism for a closure member openable relative to a frame member, one of such members being a leaf-carrying member, comprising:

a plurality of elongated latch leaves each including a latch flange and each being pivotally carried by the leaf-carrying member for swinging about an axis spaced lengthwise of such latch leaf from its latch flange and stationary relative to the latch leaf-carrying member, each latch leaf being swingable between a locking position in which its latch flange is projected outward beyond an edge of the leaf-carrying member and an unlocked position in which such latch flange is retracted to a position inward of the face of such edge;

spaced pivot means mounting the latch leaves, respectively, for swinging away from each other;

catch means carried by the other member and engageable by said latch flanges in their locking positions for locking the closure member to the frame member; and bolt means slidably received between said spaced pivot means and simultaneously engageable with said latch leaves for wedging them apart to engage said latch flanges with said catch means.

22. Locking mechanism for a closure member openable relative to a frame member comprising:

two elongated latch leaves relatively spaced apart, each of said latch leaves including a latch flange and being pivotally carried by one of the members for swinging about an axis spaced lengthwise of such latch leaf from its latch flange and stationary relative to such latch leaf-carrying member, each of said latch leaves being swingable between a locking position in which said latch flange of such latch leaf is projected outward beyond an edge of such leaf-carrying member and an unlocked position in which such latch flange is retracted to a position inward of the face of such edge;

catch means carried by the other member and engageable by both of said latch flanges in their locking positions for locking the closure member to the frame member;

bolt means located between, movable relative to and engageable with said latch leaves for moving said latch leaves to engage said latch flanges with said catch means; and resilient means for biasing the latch leaves inward relative to said bolt means.

23. The locking mechanism defined in claim 1, the bolt means being movable between an unlocked position in which the bolt means is retracted to a position inward of the edge face of the leaf-carrying member and a locking position in which the bolt means projects outward beyond such edge.

* * * * *

UNITED STATES PATENT AND TRADEMARK OFFICE

CERTIFICATE OF CORRECTION

PATENT NO. : 4,239,268

DATED : December 16, 1980

INVENTOR(S) : Harlan H. Rider

It is certified that error appears in the above-identified patent and that said Letters Patent are hereby corrected as shown below:

Column 5, line 45, cancel "and" and insert ...an...

Column 6, line 64, cancel "13" and insert ...17...

Column 8, line 27, cancel "1" and insert ...22...

Signed and Sealed this

*Tenth* Day of *March 1981*

[SEAL]

*Attest:*

RENE D. TEGTMEYER

*Attesting Officer*

*Acting Commissioner of Patents and Trademarks*